United States Patent [19]

La Rovere

[11] Patent Number: 5,054,637

[45] Date of Patent: Oct. 8, 1991

[54] CAN END FOR A TUBULAR CONTAINER

[75] Inventor: Ruggiero La Rovere, Rio de Janeiro, Brazil

[73] Assignee: Rheem Empreendimentos Industrials E Comercials S/A, Rio DeJaneiro, Brazil

[21] Appl. No.: 331,397

[22] Filed: Mar. 31, 1989

[30] Foreign Application Priority Data

Nov. 21, 1986 [BR] Brazil ..... PI 8605741[U]

[51] Int. Cl.[5] ..... B65D 6/34; B65D 8/04

[52] U.S. Cl. ..... 220/660; 220/362

[58] Field of Search ..... 29/505, 506, 509, 510, 29/511, 709; 220/67, 66, 1 R; D 9/499

[56] References Cited

U.S. PATENT DOCUMENTS 3,802,050 4/1974 Verhoest ..... 29/511 X 4,546,529 10/1985 Leon ..... 29/511 X 4,697,972 10/1987 LeBeet et al. ..... 29/509 X

*Primary Examiner*—Timothy V. Eley

[57] ABSTRACT

The present invention refers to a process for the manufacture of a basically cylindrical container provided with a can end which is lock-seamed to a longitudinally welded body without the risk of scratching the inside of the can body, by providing a sequence of operations which is adapted to high volume production, including the steps of preparation of the can body, preparation of the can tap, seating of the tap or can end, moving the can body, applying an axial force to the body wall, and transferring the can body with the can end to a final lock seaming operation.

The present invention further describes apparatus associated to the new steps of the process as well as to a specific machine for lock seaming which includes such devices, and to a can end to be lock seamed by the process.

3 Claims, 6 Drawing Sheets

PRIOR ART

PRIOR ART

CAN END FOR A TUBULAR CONTAINER

This application is a divisional of copending application Ser. No. 07/072,523, filed on July 13, 1987, and now U.S. Pat. No. 4,856,176 issued on Aug. 15, 1989.

BACKGROUND AND SUMMARY OF THE INVENTION

The present invention is directed to a process for lock seaming a cap to one end of a metal body to form a basically cylindrical container and also to an apparatus for use in such a process.

Brazilian Patent Application BR PI 8405613 of Nov. 1, 1986, shows a container, commonly referred to as a can, for packaging solid or liquid products, in which an end cap is joined to a metal body, and longitudinally welded, by means of a lock seam having body and end hooks in a perpendicular plane to the axis of the body. The patent application also describes a process by which this container can be produced. The objective of the present invention is to show a more advantageous process, especially for lock seaming ends of cylindrical metal bodies, and devices pertaining to said process.

DESCRIPTION OF THE DRAWINGS

The present invention will become more fully understood from the detailed description given hereinbelow and the accompanying drawings which are given by way of illustration only, and thus, are not limitative of the present invention, and wherein.

Figure 1:
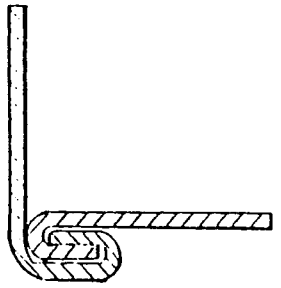
FIG. 1 shows a cross sectional view of the lock seam as described in patent application BR PI 8405613.

In the process described in patent application BR PI 8405613, the end cap to be lock seamed is lifted through one opening of the container body up to the other side by a suitable lifter, and the end's edges are engaged in the edge of the body which was previously folded toward the inside part of said can body, at an angle of 180°. Afterwards, by applying axial force, the folded part of the body and the edge of the end are formed together to make a lock seam as shown in FIG. 1. This process creates the problem that, while passing through the body, the end's edges may scratch the inside surface (generally varnished) of the body. Also, it is necessary that the body edge be folded prior to the seam-locking operation.

The present invention is directed to a new process for manufacturing a basically cylindrical container with an end cap lock-seamed to a longitudinally welded body, without the risk of scratching the inside of the can body, and providing a sequence of operations that can be easily adapted to high volume production. The resulting lock seam is similar to the one described in Patent Application BR PI 8405613 and also shows suitable means and devices for high volume production of such containers. The process consists of the following operations:

A) A cylindrical metal can body is prepared by known devices, in which the longitudinal seam is welded by electrical resistance (FIGS. 3–9).

Figure 2:
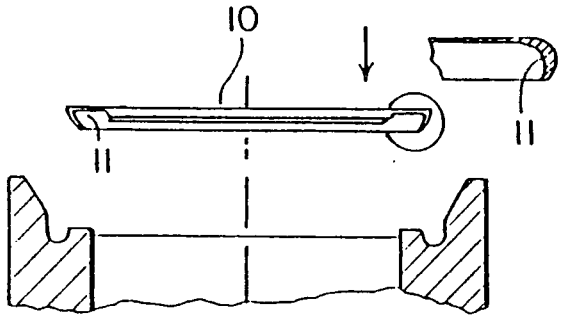
FIGS. 2, 3, 4 and 5 are cross sectional views of the sequence of the new process.

B) A round end cap with a downfolded edge is prepared, said edge forming a cylindrical or slightly conical surface (FIG. 2, element 10). The center panel of the end may protrude to increase rigidity. A ring of sealing material (11) is applied to the inside surface of the end's downfolded edge, to make a leak-proof seal when engaged by the edge of the can body.

Figure 3:
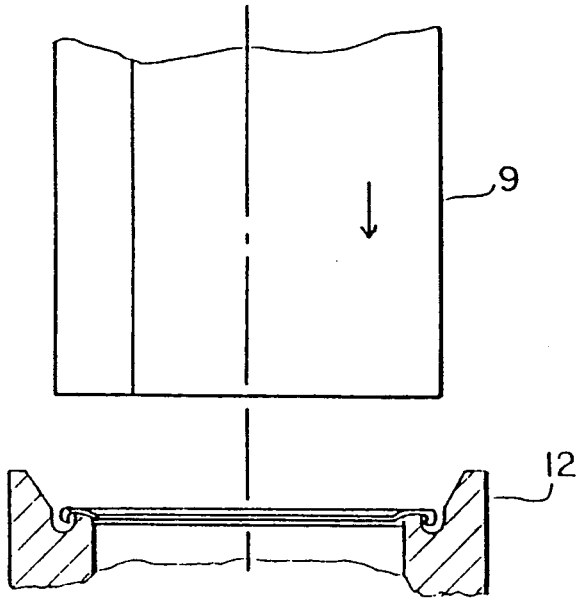

C) The above-mentioned end with edges turned downward is seated on a suitably profiled forming tool of a seam locking device (FIG. 3, element 12).

D) The above-mentioned can body is moved downward into the seam locking device in an axial direction, till it passes over the edge of the end and comes to rest on the forming tool (FIG. 3), with the inside surface of the lower edge of the can body adjoining the outside cylindrical surface of the end.

Figure 4:
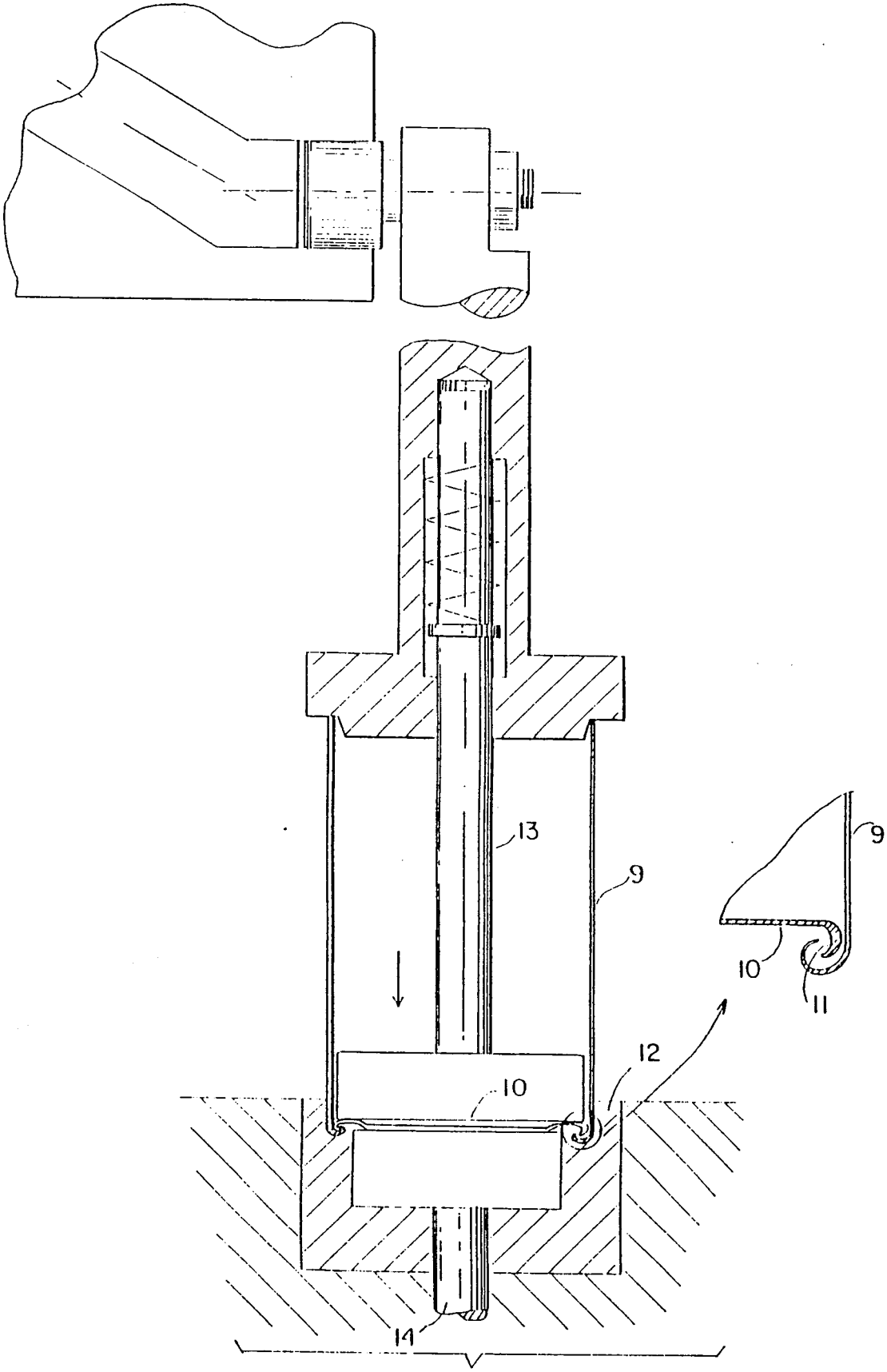

E) An axial force is applied to the body wall, forcing the lower edges of said wall to curl around the cylindrical part of the can end, until they become engaged with the sealing material on the inside of the end's cylindrical surface (FIG. 4). During this operation an inside rod (13) applies spring pressure on the end to avoid movement. At the end of this operation, which is called the "first seaming operation", a knock-out plate (14) lifts the end out of the forming tool.

F) The can body with the partially locked end is transferred to another device (FIG. 5), where the partially formed edge on the lower part of the can body is seated on a suitably profiled tool (16). A circular hammer (15) will move downward to apply pressure to shape the lock seam into its final profile, by reaction against the fixed tool (16). The lock seam is made leak-proof by the force applied by the adjacent surfaces of the can end and the can body to the ring of elastic sealing material. The above operation is called the "second seaming operation".

Figure 6:
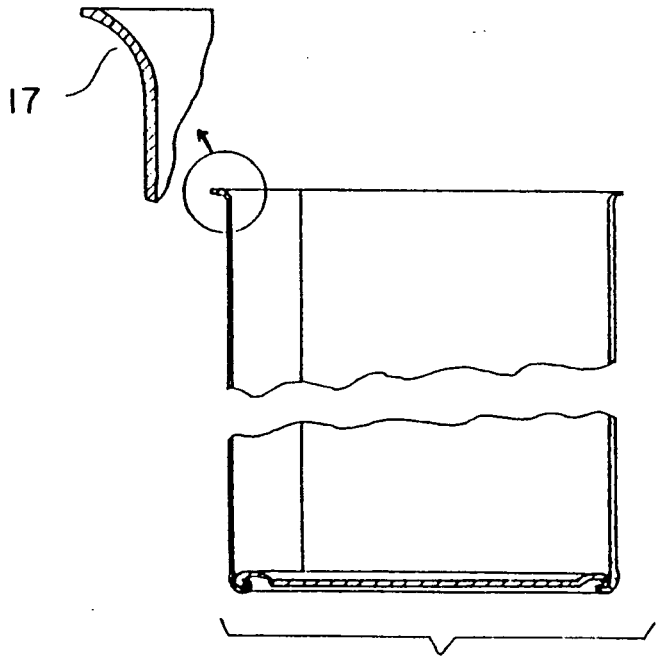
FIG. 6 is a cross sectional view showing a detail of the upper part of the can body.

G) In some cases it may be desirable that the body edge on the opposite side from the lock seam be bent outwards to form a flange (17), to which an end may be joined, after filling the container by means commonly used in the can industry (FIG. 6). In this case the device, described in (C), (D), and (E) above will be provided on the upper side with a flanging tool (19), of a type commonly used in the industry, the novelty of the device being its working in connection with the forming tool of the first seaming operation (FIG. 6). The reaction to the axial force producing the curling of the body edge described in (E) will force the upper edge to open in a flange form, till it hits the stop ring (18), which limits the operation.

This stop ring has a spring action, and it works as an extractor when the device lifts after the first seaming operation.

Figure 7:
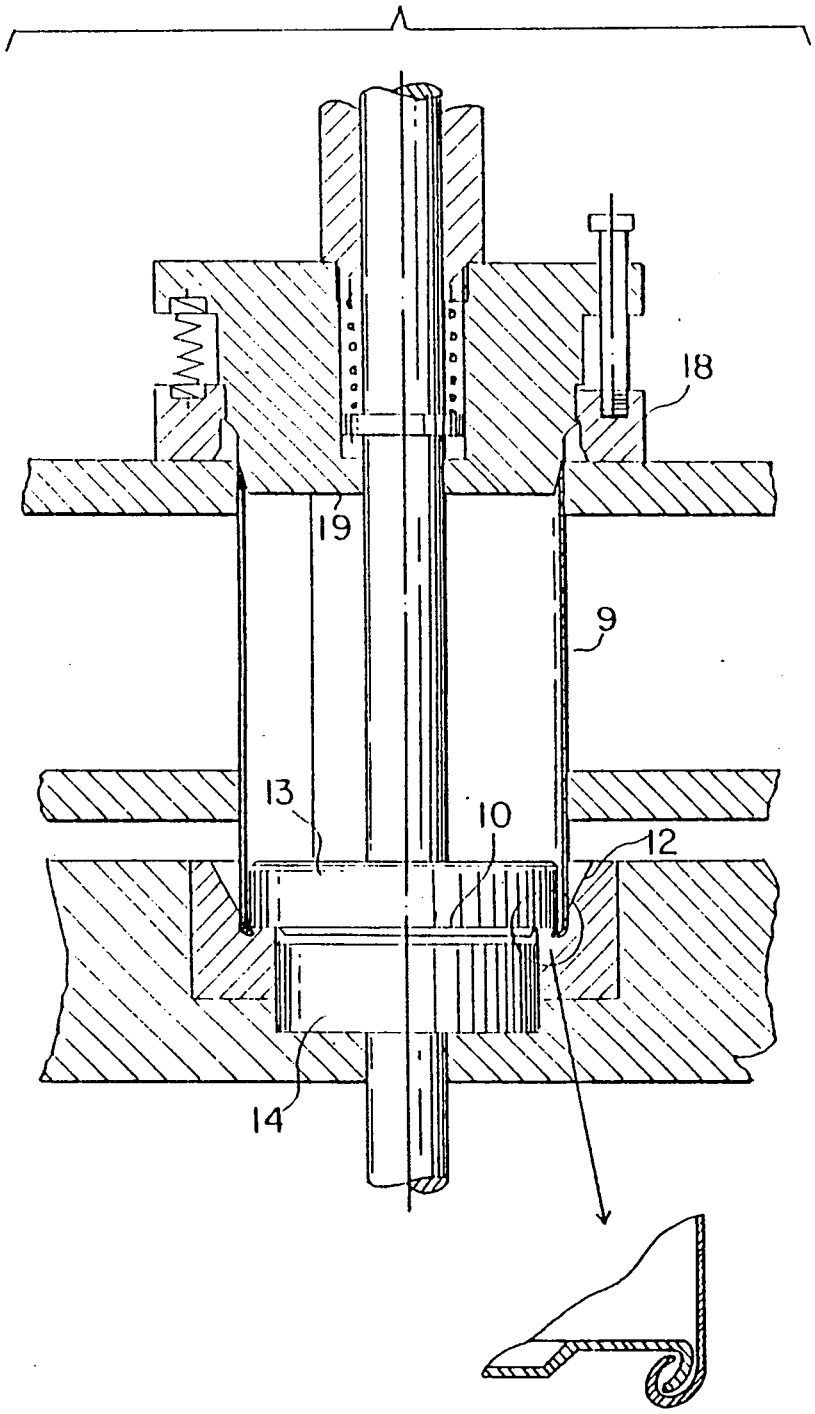
FIG. 7 is a cross sectional view showing a preferred design of the device which performs the first operation of the new lock-seaming process.
Figure 8:
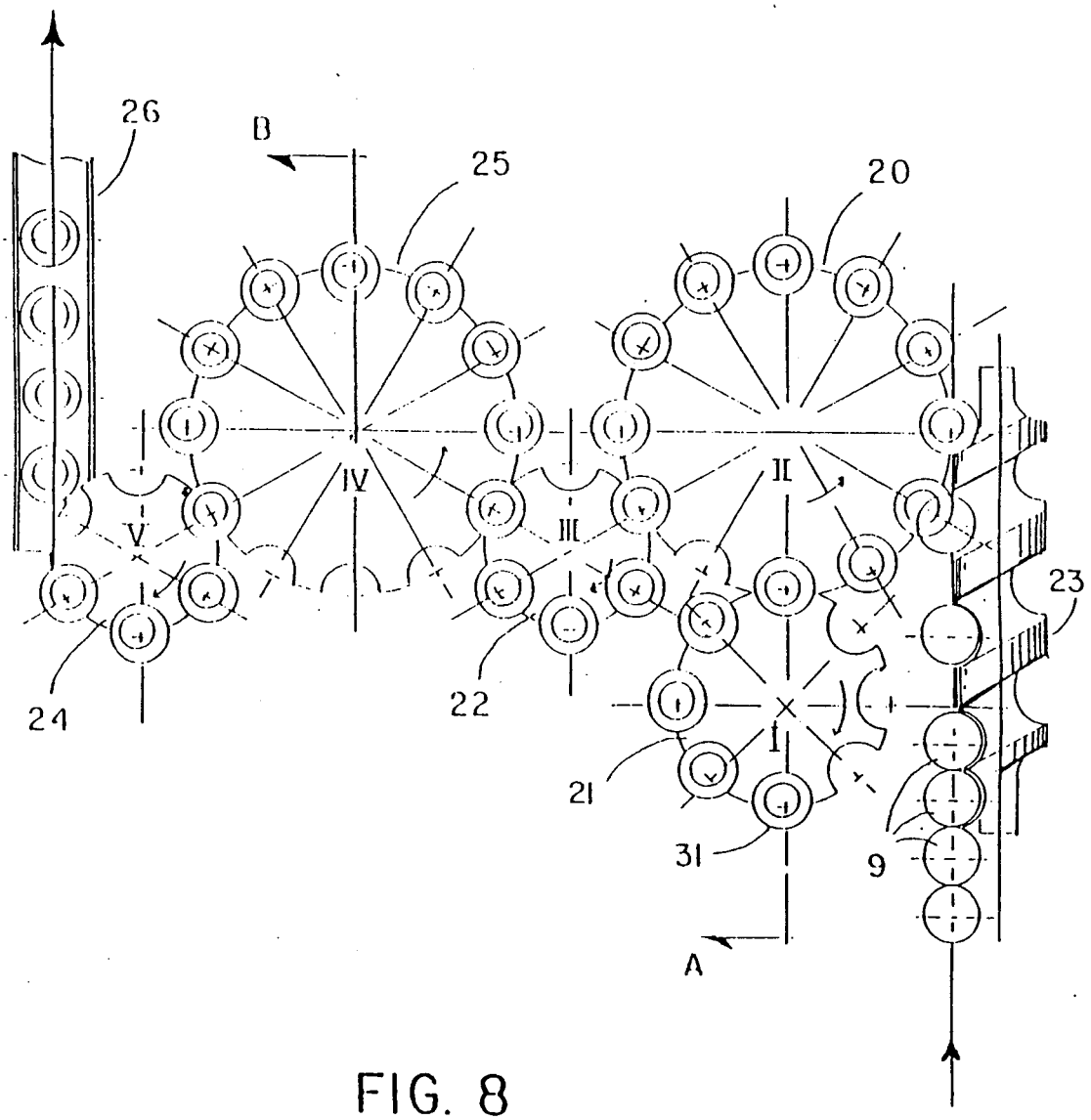
FIG. 8 is a schematic lay-out of a system utilized for mass production of lock-seamed containers.
Figure 9:
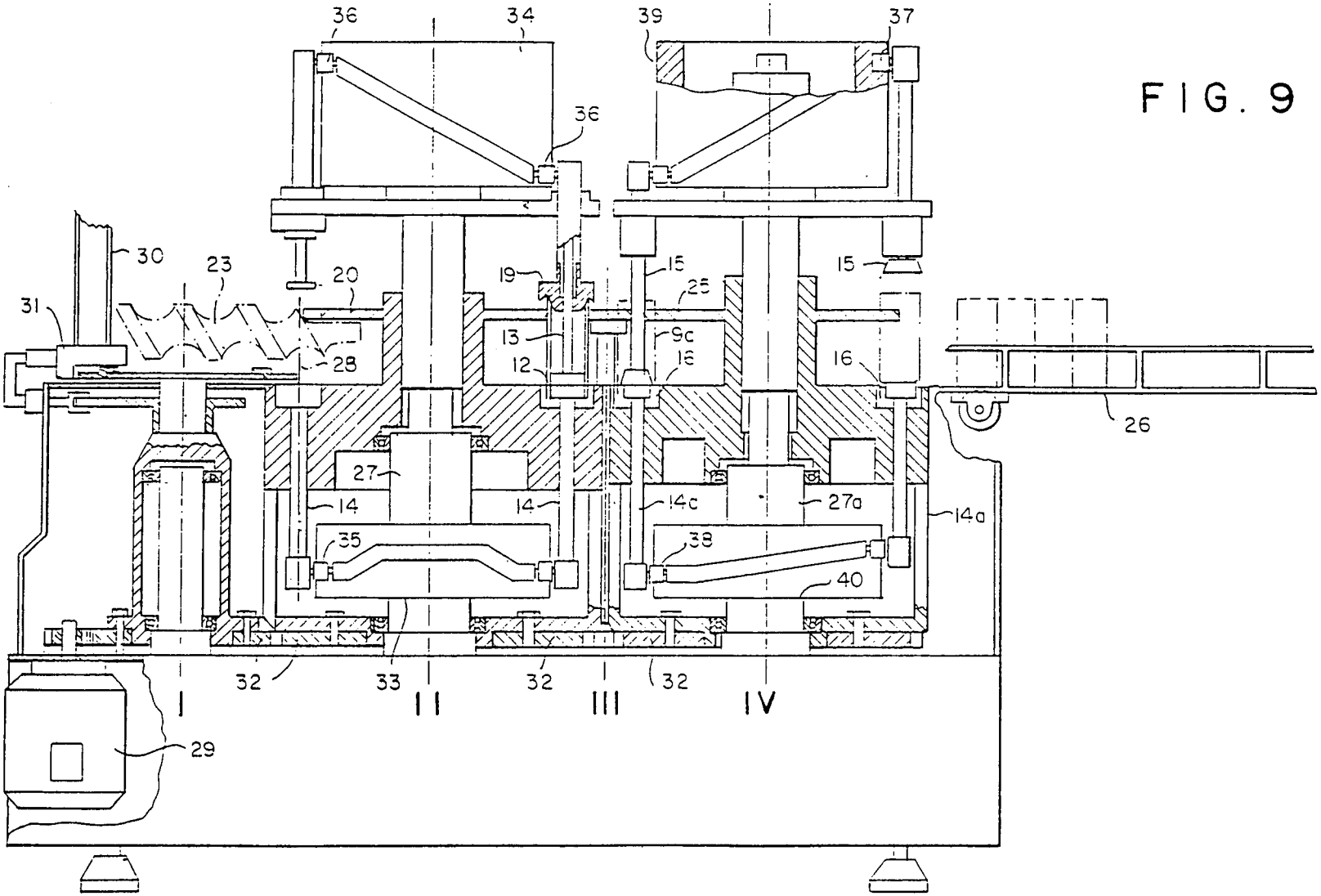
FIG. 9 is a schematic cross section, non-proportional, of the device shown in FIG. 8 made along lines A-I-II-IV-B shown in FIG. 8.

For mass production, the devices used in the above process may be applied to a machine shown in FIG. 8, that shows a schematic view from above and FIG. 9, which shows a cross section of the machine along the line A-I-II-IV-B shown in FIG. 8. This type of machine is well known in the industry, under the name of "Canomat", the novelty being the combination of the forming devices described in paragraphs (A) to (G) above and shown in FIGS. 4, 5, 6 and 7.

In the proposed assembly (see FIGS. 8 and 9), wheel (21) is used to transfer ends from a destacking device (31) to wheel (20), by processes and devices (28) already known that hold ends peripherally on wheel (21). On the point of tangency of wheel (21) to wheel (20) the ends are transferred to wheel (20), on top of tools (12) mounted there. On wheel (20) are peripherally assembled several devices of the type described in paragraphs (C), (D), (E) and (G) (FIGS. 4 and 7), the vertical movement of parts of said devices being provided by cam followers (35) and (36) running on fixed circumferential cams located concentrically under and above said wheel (20). Linear feeder (23) is of the plastic screw type commonly used to feed cylindrical bodies onto rotating devices. On wheel (25) are assembled peripherally several devices described in paragraph (F) and shown in FIG. 5 (15–16), in which vertical movements are provided by cam followers (37) and (38) running on fixed circumferential cams (39) (40). Wheels (22) and (24) are transfer wheels that by known devices such as spring loaded holders or magnets pick up cans at tangency points and transfer them from wheel (20) to wheel (25), or from wheel (25) to linear conveyor (26). Conveyor (26) is used to take bodies with lock-seamed ends away from the machine. Wheels (21), (20), (22), (24), (25) and screw (23) are linked by gears (32) placed under the wheels in order to assure a synchronized movement and moved by one single motor (29), which is usual in such machines. The machine operation is as follows:

1) Can ends from a destacker (31) are carried by wheel (21) towards wheel (20), and at the point of tangency between wheel (21) and wheel (20) the can ends are dropped over lifter (14), (by action of roller (35) in lower cam (33)), then lowered into forming ring (12) as shown in FIG. 2 (8 and 9). The operation is continuous, each forming device on the periphery of wheel (20) receiving one can end.

2) By means of endless screw (23), a metal body (19) is transferred to the peripherally mounted forming device (12, 13, 14, 19) in wheel (20), where said body is held, by means of side mounted springs or magnets, concentrically above the can ends which are already sitting on the forming tool (12) (FIG. 3).

3) As wheel (20) progresses in its circular travel rollers (36) linked to part (19), that roll over a circular, fixed cam (34) mounted on the upper part of the machine, element (19) is moved downwards by action of the cam's profile, forcing the body against forming tool (12), to complete the first seaming operation.

Figure 5:
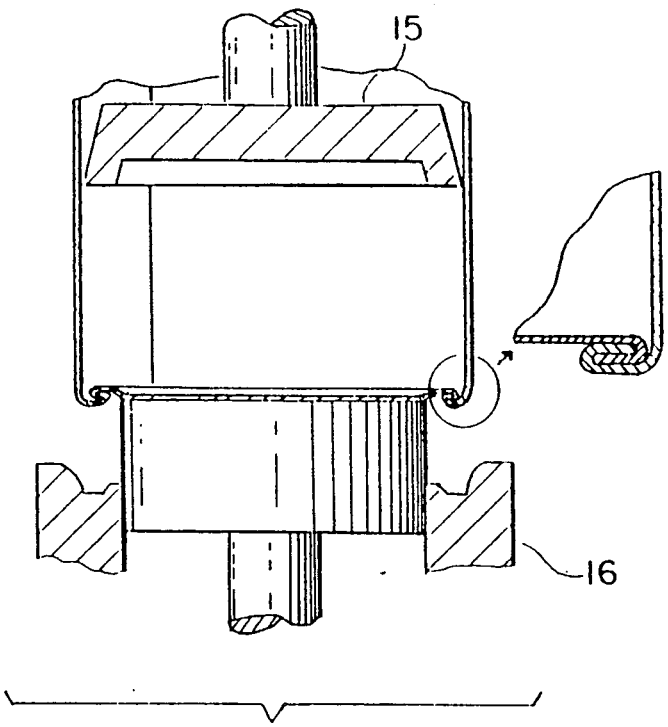

4) Continuing its circular motion, wheel (20) will become tangent to wheel (22). At the tangency point the body with the partially seamed end, is transferred to the cavity on wheel (22) and is held (by springs or magnets) till by the circular movement of said wheel (22), it becomes tangent to wheel (25), at this point it is removed to a peripherally mounted forming device (16) assembled to wheel (25), and placed above a forming tool as shown in FIG. 5. Soon thereafter, by action of a roller (37) running over a cam (39) fixed to the upper point of the machine, hammer (15) is lowered inside the container body and presses the bottom end against tool (16), processing the final tightening of the seam. The seamed can is then ejected from the tool (16) by vertical movement of part (14*a*) driven by roller (38) running in lower cam (40). All the devices described above, of wheels synchronized with feeders and to each other, for transferring ends and bodies from one wheel to the other, and tools moving vertically by roller and cam action are all known in the can making industry. The novelty of the machine consists in its use with devices as shown in FIG. 4, FIG. 5 and FIG. 7 of the present application.

It should be further noted that the can end is somewhat similar to a conventional end. It has a coating lacquer on one side, intended to prevent contact between the canned product and the end metal and the lining compound (FIG. 2, element 11) on the other side (outside) which is different from what is seen in conventional can ends in which the lining compound is applied to the same side (inside) where the coating lacquer is applied. The container annular wall allows for centering onto a support tool not providing for the function of radial support of a conventional seaming mandrel, movement of the body up to the end and past the same to form a down turned edge and the ability of flanging the upper end of the body by means of a stop or abutment ring and thereafter urging the lower end into the seaming die profile, are also characteristic features of the invention.

The invention being thus described, it will be obvious that the same may be varied in many ways. Such variations are not to be regarded as a departure from the spirit and scope of the invention and all such modifications as would be obvious to one skilled in the art are intended to be included within the scope of the following claims.

I claim:

1. A can end adapted to be mounted to the end portion of a cylindrical container and having an inside surface and an outside surface, said can end comprising a flat circular central panel, an annular wall portion extending from the periphery of the flat circular central panel in the upward or downward direction relative to said central panel, a flat circular area extending radially from the annular wall portion, said flat circular area having a down turned edge portion so arranged that the down turned edge portion, flat circular area and annular wall portion define a channel, and a gasket in the form of a sealing material, disposed in a corner defined by the down turned edge and the flat circular area and on the side of the can end corresponding to the outside of the cylindrical container for achieving a leak proof seal when engaged by the end portion of the cylindrical container.

2. The can end according to claim 1, wherein the down turned edge portion is in the form of an annulus of arcuate cross section having a free edge thereof which extends inboard of the outermost end of the down turned edge portion.

3. The can end according to claim 1, wherein a coating lacquer covers the inside surface, which after assembly, is in contact with the canned product and whereas said sealing material is applied at the side opposite to the side which, after assembly, constitutes the inside of the can.

* * * * *